US005090623A

United States Patent [19]

Burns et al.

[11] Patent Number: 5,090,623

[45] Date of Patent: Feb. 25, 1992

[54] PAINT SPRAY GUN

[75] Inventors: Marvin D. Burns, Millbury; Alan H. Fritz, Toledo, both of Ohio; Thomas E. Grime, Temperance, Mich.

[73] Assignee: Ransburg Corporation, Indianapolis, Ind.

[21] Appl. No.: 622,853

[22] Filed: Dec. 6, 1990

[51] Int. Cl.[5] ..... B05B 1/02; B05B 1/30

[52] U.S. Cl. ..... 239/301; 239/300

[58] Field of Search ..... 239/290, 296, 297, 300, 239/301

[56] References Cited

U.S. PATENT DOCUMENTS

| | | | |
|---|---|---|---|
| 1,849,300 | 3/1932 | Jenkins | 239/301 |
| 1,982,055 | 11/1934 | Jenkins | 239/301 |
| 2,060,894 | 11/1936 | Potter | 239/301 |
| 2,740,670 | 4/1956 | Harder | 239/301 |
| 2,786,716 | 3/1957 | Peeps | 239/301 |
| 3,687,368 | 8/1972 | Geberth, Jr. . | |
| 3,930,615 | 1/1976 | Farnsteiner | 239/419.5 |
| 4,531,675 | 7/1985 | Muck | 239/290 |
| 4,744,518 | 5/1988 | Toth | 239/297 |

OTHER PUBLICATIONS

DeVilbiss Service Bulletin SB-2-234A, 1988, The DeVilbiss Company.

Drawing made from an Optima 802 HVLP spray gun (date unknown).

*Primary Examiner*—Andres Kashnikow

*Assistant Examiner*—Karen B. Merritt

*Attorney, Agent, or Firm*—MacMillan, Sobanski & Todd

[57] ABSTRACT

An improved high volume low pressure air (HVLP) operated paint spray gun of the type having adjustable fan air and suitable for operation from a high pressure air source. The high pressure air passes from a high pressure chamber through first or second parallel calibrated orifices to supply both low pressure atomization air and low pressure fan air for controlling the shape of the spray pattern. In one embodiment, both orifices supply air to a low pressure chamber which in turn supplies both atomization air and fan air. A fan air control ring adjusts the flow of low pressure air to fan jet orifices. Rotating the fan air control ring controls both air flow through the second orifice to the low pressure chamber and air flow from the low pressure chamber to the fan jet orifices. In a second embodiment, one orifice supplies only low pressure atomization air and the other orifice supplies only low pressure fan air. A valve adjusts the flow of fan air.

11 Claims, 5 Drawing Sheets

PAINT SPRAY GUN

TECHNICAL FIELD

The invention relates to air atomization paint spray guns and more particularly to an improved paint spray gun which reduces high pressure source air to a high volume low pressure flow for paint atomization and for controlling the shape of the spray pattern.

BACKGROUND ART

In the past, air atomization type paint spray guns typically operated with high pressure air to atomize the paint and to adjust the spray pattern between a round pattern and an oval or fan shaped pattern. High pressure air was readily available from compressors and from existing factory air lines and was effective at atomizing a wide range of coating materials. However, the high air pressure tends to produce a less than optimum coating transfer efficiency. Consequently, an undesirable amount of coating material may be dispersed into the atmosphere. Recently, there has been an increased use of high volume low pressure (HVLP) air operated paint spray guns because of the higher transfer efficiency and the resulting decrease in air pollution. In some states such as California, HVLP spray guns operated at 10 psig or less air pressure at the nozzle are exempt from requirements for proving that they meet a minimum transfer efficiency.

HVLP paint spray guns are designed to operate either from a low pressure air source or from a high pressure air source. Typically, a low pressure air source may have an air pressure between 5 and 10 psig while a high pressure air source may have an air pressure between 60 and 100 psig. Guns operated from a low pressure air source have certain disadvantages over guns operated from a high pressure air source. In most cases, high pressure air is already available from an existing air compressor or from an existing high pressure air line in a shop or factory. When a gun is operated from a low pressure source, a separate low pressure turbine must be purchased to operate the spray gun. Such turbines are expensive. Further, a relatively large diameter hose is required to carry the high air flow volumes required to operate the spray gun at a low air pressure. Such hoses are substantially more cumbersome than the smaller diameter high pressure air hoses and consequently increase operator fatigue.

When an HVLP spray gun is operated from a high pressure air source, the high pressure air is metered through either a valve or a fixed orifice to obtain a desired low pressure. When the low pressure supplies both atomization air and fan air, there has been difficulty in accurately controlling the atomization air pressure, especially when the fan air is adjusted. It is critical that the maximum atomization air pressure never exceed 10 psig to meet statutory and regulatory requirements in some jurisdictions. At the same time, it is desirable to have the atomization air pressure close to the maximum permitted 10 psig for improved atomization. When the air pressure is dropped through an orifice or a valve from a high pressure to a low pressure, the pressure of the low pressure air is dependent on air flow. If the low pressure air also supplies fan air orifices, the atomization air pressure will increase when the fan air flow is decreased. If a fixed orifice is sized to give exactly 10 psig, when fan air is totally interrupted, the atomization air pressure may drop to about 5 or 6 psig, for example, with maximum fan air flow. The lower atomization air pressure will adversely affect the paint atomization quality.

Various methods have been used to limit fluctuations in atomization air pressure when fan air flow is changed. In one HVLP spray gun, fan air is controlled by a needle valve. The valve needle has two valve portions forming two valves which operate together, a first of which controls both atomization air and fan air and a second of which controls only fan air. The first valve forms the pressure reducing orifice for dropping the high pressure source air to a desired low pressure. When the valve needle is moved to adjust fan air flow through the second valve, there is a simultaneous adjustment of total air flow through the first valve to limit the atomization air to a predetermined maximum pressure.

U.S. Pat. No. 3,687,368 relates to an electrogasdynamically powered electrostatic spray gun in which the constant flow of atomization air is used to generate an electrostatic voltage. A single air source supplies both the atomization air and fan air. A special bleeder valve is used to prevent changes in the atomization air pressure when fan air is adjusted. As the flow of fan air is decreased, an increased amount of air is vented to the atmosphere to maintain a constant air flow through the gun and hence to maintain a constant atomization air pressure.

DISCLOSURE OF INVENTION

According to the invention, an improved HVLP spray gun is provided for operation from a high pressure air source. In one embodiment of the invention, compressed air flows from a high pressure chamber through two parallel calibrated orifices to a low pressure air chamber. The low pressure chamber supplies both atomization air and fan air. The fan air flows through holes in a baffle to fan air orifices in an air cap. A fan spray adjusting ring is positioned between the baffle and the low pressure chamber. The ring is rotated to increase or decrease air flow from the low pressure chamber thought the baffle to the fan air orifices. The fan spray adjusting ring also controls air flow from the high pressure chamber through one of the calibrated orifices to the low pressure chamber. When the adjusting ring is rotated to reduce fan air flow, the adjusting ring simultaneously reduces the flow through one of the calibrated orifices. When fan air is totally interrupted, air flow through this orifice also is interrupted. The calibrated orifice which is always open is sized to provide the desired atomization air pressure when fan air is interrupted. The calibrated orifice which is blocked when fan air is interrupted is sized relative to the unblocked orifice to provide the additional air flow required when full air flow is delivered to both the fan air orifices and the atomization air orifices. Consequently, the spray gun will have the same atomization air pressure when full fan air is flowing as when fan air is totally interrupted.

In a second embodiment of the invention, high pressure air is again dropped to low pressure air through two parallel calibrated orifices. However, a first of the calibrated orifices delivers only low pressure atomization air and a second of the calibrated orifices delivers only fan air. A valve controls the flow of fan air through the second orifice. When the valve is closed to interrupt fan air, there will be a slight increase in the pressure of the high pressure air which in turn produces a slight increase in the atomization air pressure.

Accordingly, it is an object to provide an improved HVLP spray gun of the type having adjustable fan air and suitable for operation from a high pressure air source.

Other objects and advantages of the invention will be apparent from the following detailed description and the accompanying drawings.

BEST MODE FOR CARRYING OUT THE INVENTION

Figure 1:
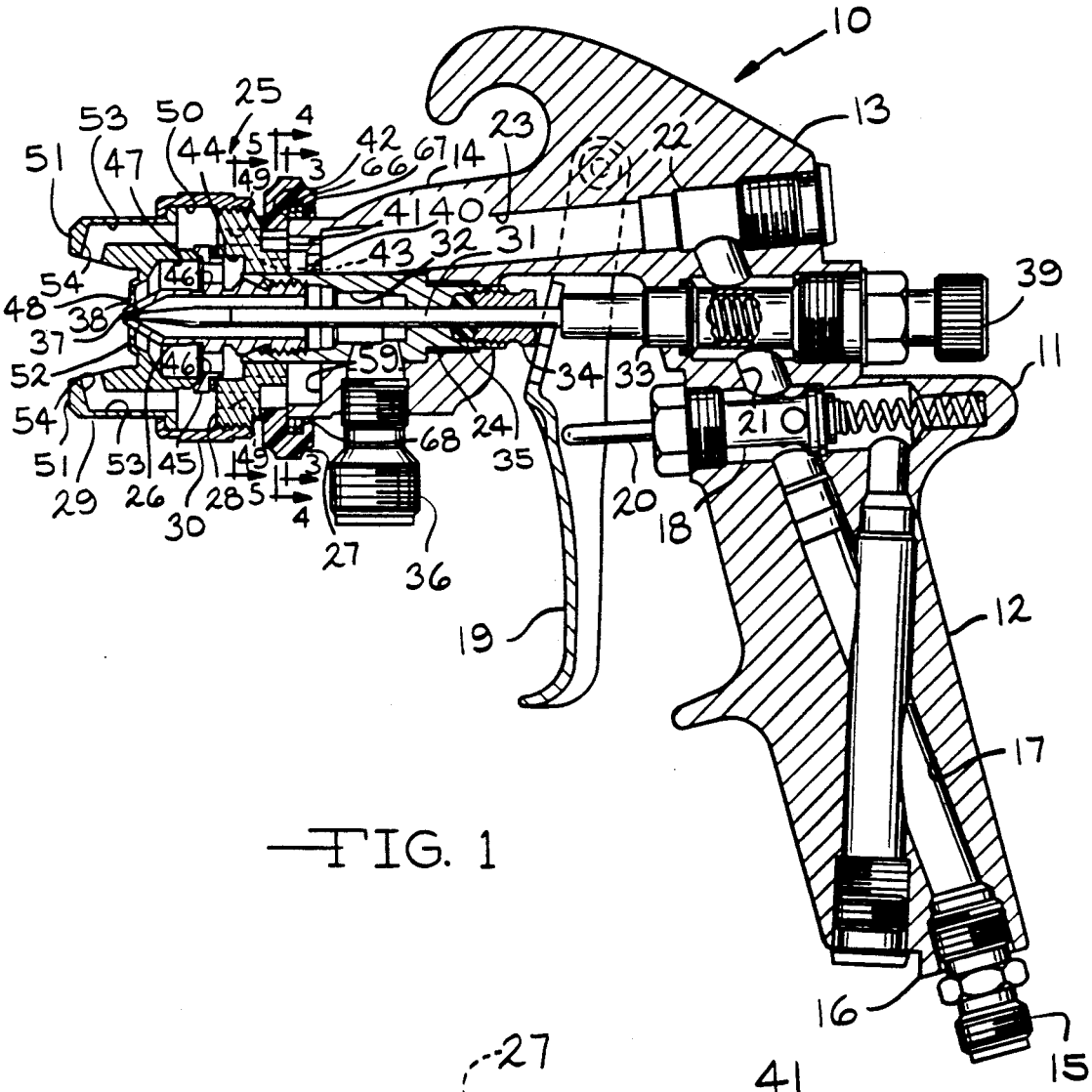
FIG. 1 is a vertical cross sectional view through an HVLP paint spray gun for operation from a high pressure compressed air source according to one embodiment of the invention.

Referring to FIG. 1 of the drawings, a paint spray gun 10 is illustrated according to one embodiment of the invention. The spray gun 10 has a metal body 11 shaped to form a handle 12 connected to an upper body section 13 which in turn connects to a front body section 14. An air inlet fitting 15 is secured to a lower end 16 of the handle for attaching a high pressure air hose from a remote compressed air source (not shown), such as a shop air line or an air compressor. The air fitting 15 connects to a passage 17 through the handle 12 to an air valve 18. The air valve 18 is actuated by an operator of the spray gun 10 squeezing a trigger 19 to press on a valve plunger 20. When the trigger 19 is squeezed, high pressure air flows through the valve 18 to a passage 21 in the upper body section 13 to a high pressure air chamber 23 which extends into the front body section 14.

A generally tubular insert 24 is mounted in the front body section 14. A nozzle assembly 25 including a spray tip 26, a fan air control ring 27, a baffle 28, an air cap 29 and an air cap retainer ring 30 are secured to the insert 24. The spray tip 26 is threaded into the insert 24 to retain the nozzle assembly 25 on the front body section 14. A valve needle 31 extends from a paint chamber 32 in the spray tip 26 and the insert 24 coaxially through the insert 24, through the trigger 19 to an insert 33 secured in the upper body section 13. A packing nut 34 is threaded into the insert 24 to press a seal 35 against the needle 31. The seal 35 allows the needle 31 to reciprocate while preventing paint leakage from the chamber 32.

A fitting 36 is secured to the front body section 14 for connection to a conventional paint source (not shown), such as either a suction feed or a pressure feed paint cup or a hose connected to a remote pressurized paint source. The fitting 36 connects with the chamber 32. Normally, a tip 37 on the valve needle 31 is seated against the spray tip 26 to close a paint discharge orifice 38. When the trigger 19 is squeezed, the valve needle 31 is moved to open the orifice 38, allowing paint to be discharged from the spray gun 10. The insert 33 contains a return spring for urging the valve needle 31 to seat against the spray tip 26 when the trigger 19 is released and has an adjustment knob 39 for adjusting the paint flow when the trigger 19 is squeezed.

As stated above, squeezing the trigger 19 opens the valve 18 to apply high pressure air to the chamber 23. The chamber 23 is closed, except for two calibrated, parallel orifices 40 and 41 which extend through a front face 42 on the front body section 14. At least a portion of the air flowing through the orifices 40 and 41 flows through passages 43 between the baffle 28 and the insert 24 to a chamber 44. A radial flange 45 extending around the spray tip 26 has a number of spaced holes 46 which connect the chamber 44 to a chamber 47 between the air cap 29 and the spray tip 26. An annular orifice 48 extends between the air cap 29 and the spray tip 26 for discharging atomization air from the chamber 47 concentrically around paint discharged from the spray tip orifice 38 whenever the trigger 19 is squeezed. The air pressure in the chamber 47 and, therefore, the amount of atomization air discharged from the annular orifice 48, is determined by the size of the orifices 40 and 41.

Compressed air flowing through the orifices 40 and 41 also flows through the fan air control ring 27, through a plurality of passages 49 in the baffle 28 to a chamber 50. The air cap 29 has two horns 51 which project from a front surface 52 on diametrically opposite sides of the orifices 38 and 48. A separate passage 53 extends through each of the horns 51 and terminates at an orifice 54 which is located to direct fan or pattern shaping air in a forwardly and inwardly direction at the envelope of atomized paint. If no fan air is discharged from the orifices 54, the atomized paint will have a round envelope in a plane perpendicular to the axis of the envelope. As an increased amount of fan air is discharged from the horn orifices 54, the atomized paint envelope will change from the round pattern to an oval or flat fan shaped pattern.

Figure 2:
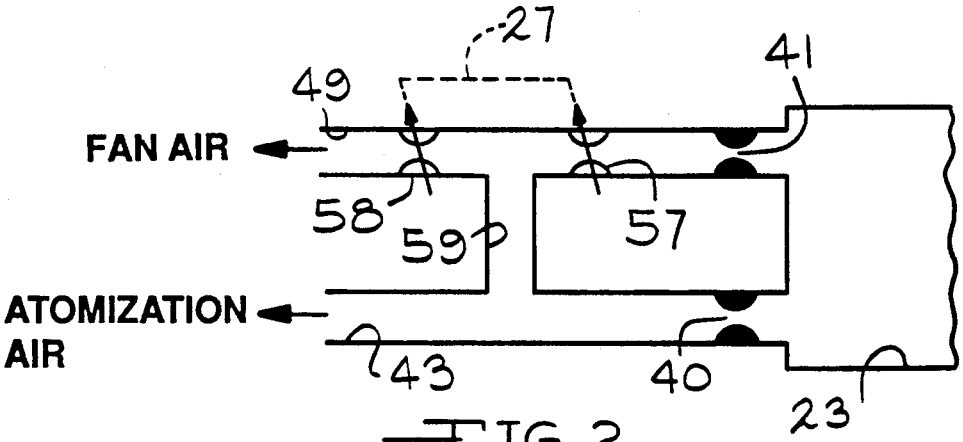
FIG. 2 is diagrammatic view showing the air flow through a portion of the body and nozzle assembly for the spray gun of FIG. 1.

The operation of the fan air control ring 27 in the spray gun 10 is diagrammatically illustrated in FIG. 2. The fan air control ring 27 forms two valves 57 and 58 which control the flow of air from the high pressure chamber 23 through the orifice 41 to a low pressure chamber 59 and from the low pressure chamber 59 to baffle passages 49 and thence to the horn orifices 54. The orifices 40 and 41 are connected in parallel between the high pressure chamber 23 and the low pressure chamber 59. The low pressure chamber 59 also is connected to deliver atomization air through the passages 43 to the orifice 48. So long as high pressure air is delivered to the chamber 23, such air will flow through the orifice 40, the chamber 59, the passages 43, the chamber 44, the passages 46 and the chamber 47 and finally will be discharged from the atomization air orifice 48. When the valve 57 is open, a portion of the air flowing through the orifice 41 will flow along the same path to the atomization air orifice 48. The orifices 40 and 41 are sized and the fan air control ring 27 is designed to maintain a substantially constant pressure in the chamber 59 for various settings of the control ring 27. The pressure in the chamber 59 can be maintained to not exceed a predetermined maximum pressure as required by statutes and regulations in certain jurisdictions for limiting air pollution. For example, the orifices 40 and 41 may be sized to limit the pressure in the chamber 59 to 10 psig to meet California requirements. When the valve 58 is closed, there is a tendency for the decrease in the total atomization and fan air flow to produce an increase in the pressure in the chamber 59. According to one embodiment of the invention, the valve 57 is simultaneously closed or opened with the valve 58 at a rate to maintain a more uniform pressure in the chamber 59 when the total air flow through the spray gun 10 is changed.

Figure 3:
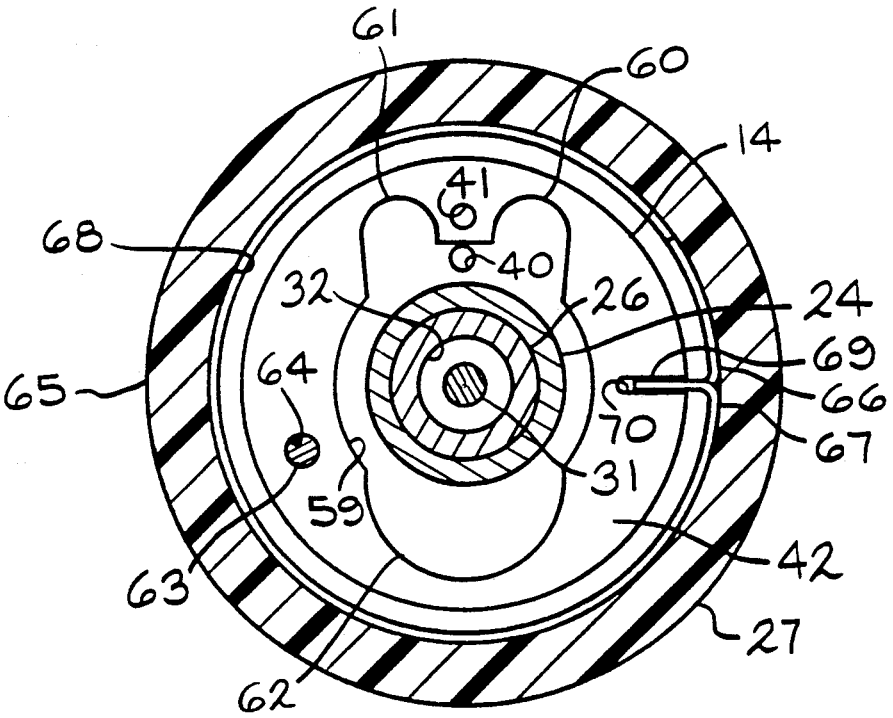
FIG. 3 is a cross sectional view as taken along line 3—3 of FIG. 1.
Figure 4:
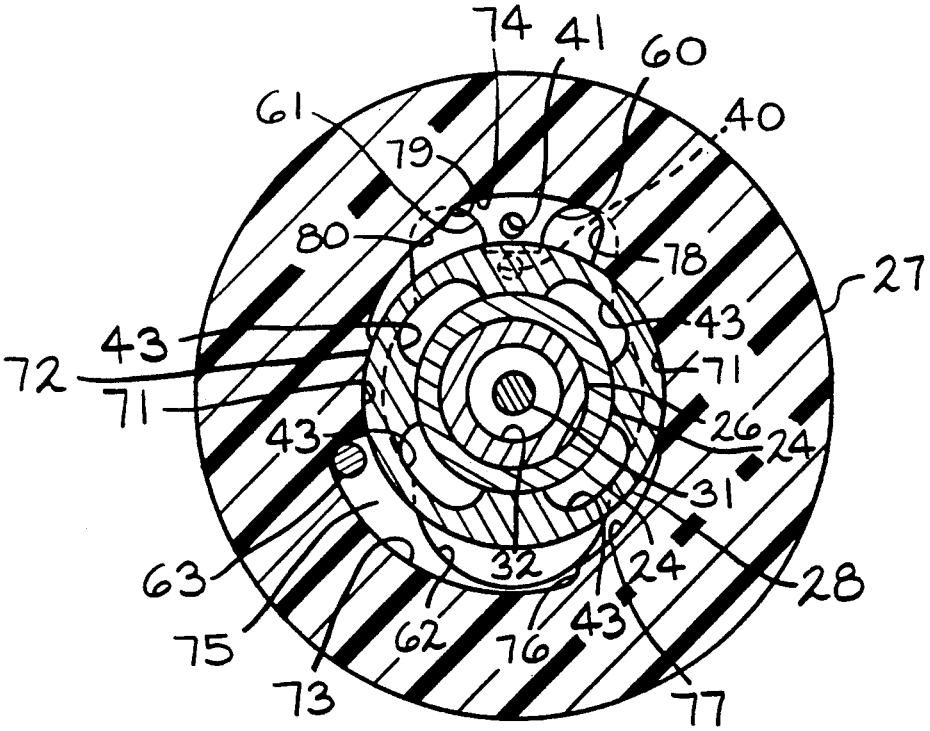
FIG. 4 is a cross sectional view as taken along line 4—4 of FIG. 1.
Figure 5:
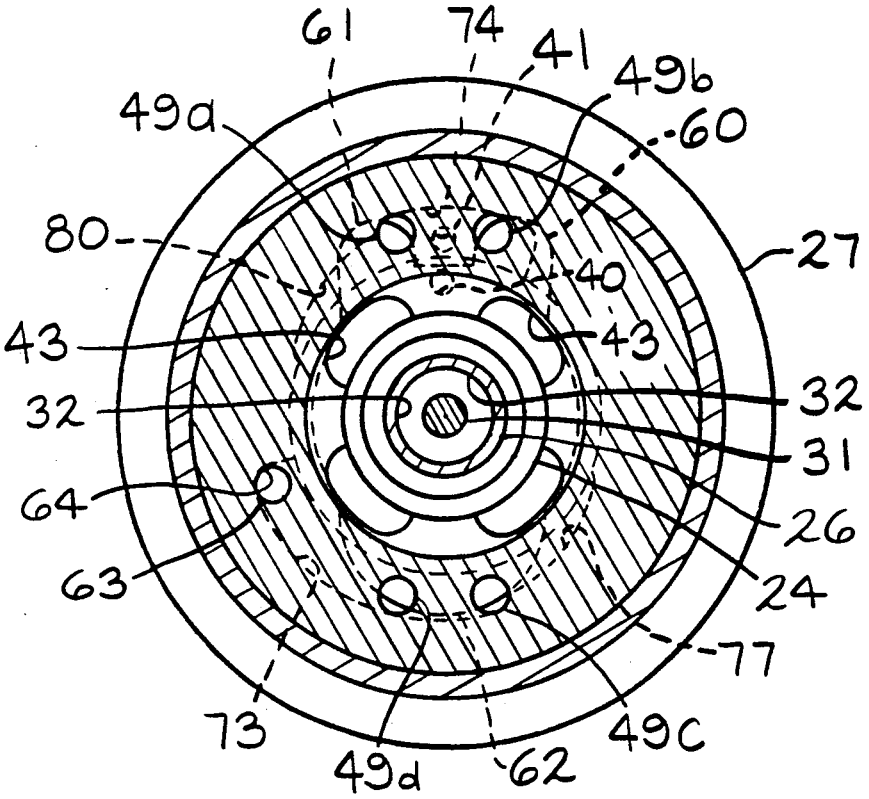
FIG. 5 is a cross sectional view as taken along line 5—5 of FIG. 1.

FIGS. 3-5 illustrate construction details and the operation of the front body section 14, the fan air control ring 27 and the baffle 28 for controlling fan air and for limiting fluctuations in the atomization air pressure as fan air is adjusted. FIG. 3 is a cross sectional view through the spray gun 10 looking at the front body section face 42. The front face 42 surrounds the orifice 40. The low pressure cavity 59 is formed in the front face 42 to include the orifice 40 and to extend around the insert 24. The cavity 59 includes two lobes 60 and 61 located on opposite sides of the orifice 41 and a lobe 62 located diametrically opposite from the orifices 40 and 41. As shown in FIG. 3, a locating pin 63 on the baffle 28 extends into an opening 64 through the face 42. The control ring 27 has a rim 65 which surrounds the face 42. A pair of spiral springs 66 and 67 are located in an annular groove 68 in the control ring rim 65. The springs 66 and 67 are oriented in opposite directions in the groove 68 and each has an end 69 extending into a notch 70 in the front body section. The springs 66 and 67 are compressed in the groove 68 to provide controlled friction against rotation of the control ring 27.

Figure 7:
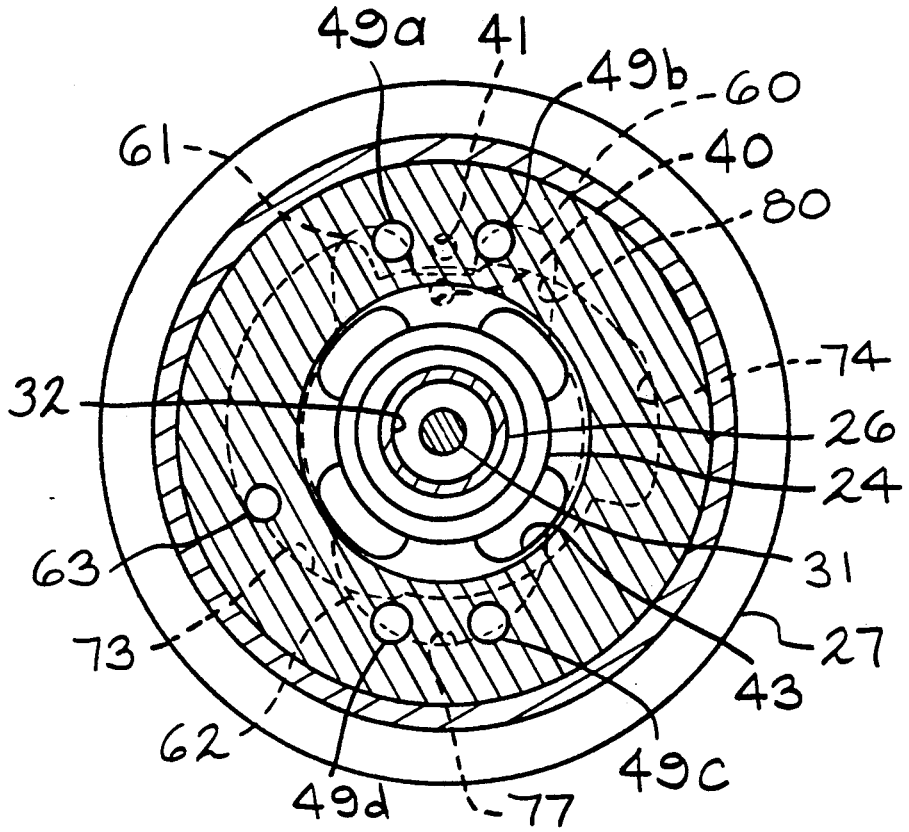
FIG. 7 is a cross sectional view similar to FIGS. 5 and 6, but showing the fan air control ring rotated to totally block fan air flow.

FIG. 4 is a cross sectional view through the control ring 27 at a location spaced in front of the front body face 42. The control ring 27 has an axial opening with surface portions 71 which abut an exterior surface 72 on the baffle 28 to confine the control ring 27 to rotate about its axis. Two slots 73 and 74 are formed in the control ring 27 adjacent the baffle surface 72. The baffle locating pin 63 extends through the slot 73. The slot 73 and the pin 63 cooperate to limit rotation of the control ring 27 between a first position (as shown in FIGS. 4 and 5) when an end 75 of the slot 73 abuts the pin 63 and a second position (as shown in FIG. 7) when an intermediate section 76 of the slot 73 abuts the pin 63. The slot 73 has an end section 77 which spirals inwardly from the section 76 to the control ring surface 71. The slot 74 has an end 78, an intermediate section 79 and an end section 80 which spirals inwardly to the control ring surface 71. Low pressure compressed air will flow uninhibited from the orifice 41 into the slot 74 and thence into the low pressure chamber 59 so long as the control ring 27 is positioned with the orifice 41 between the slot end 78 and the intermediate slot section 79. As the control ring 27 is rotated further towards the second position, the intermediate section 79 and the end section 80 are located to progressively block the orifice 41. As the orifice 41 becomes blocked, air flow from the orifice 41 to the chamber 59 is reduced until it is totally inhibited at the second control ring position.

Figure 6:
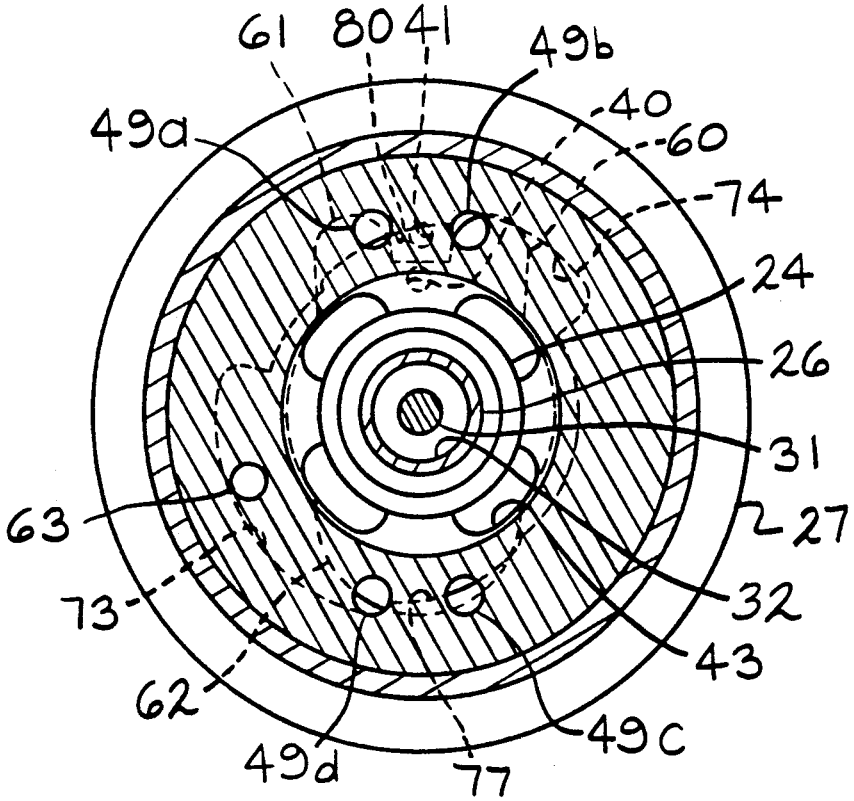
FIG. 6 is a cross sectional view similar to FIG. 5, but showing the fan air control ring rotated to partially block fan air flow.

FIGS. 5-7 illustrate the function of the control ring 27 for controlling the flow of fan air and for simultaneously limiting the maximum atomization air pressure. FIG. 5 shows the control ring 27 in the first position with full fan air flowing, FIG. 6 shows the control ring 27 in an intermediate position with fan air flow reduced, and FIG. 7 shows the control ring 27 in the second position with fan air flow inhibited. Four holes **49*a*, 49*b*, 49*c* and 49*d* extend through the baffle 28 for delivering fan air to the chamber 50. The hole 49*a* is aligned through the control ring 27 with the lobe 61 of the low pressure chamber 59, the hole 49*b* is aligned through the control ring 27 with the lobe 60 of the low pressure chamber 59 and the holes 49*c* and 49*d* are aligned through the control ring 27 with the lobe 62 of the low pressure chamber 59**.

When the control ring 27 is in the first position as shown in FIG. 5, the control ring slot 74 connects the baffle holes **49*a* and 49*b* with the low pressure chamber 59 and connects the orifice 41 with the low pressure chamber 59. At the same time, the control ring slot 73 connects the baffle holes 49*c* and 49*d* with the low pressure chamber 59. Consequently, both orifices 40 and 41 deliver low pressure air to the chamber 59 which in turn supplies a full flow of atomization air to the orifice 48 and a full flow of fan air to the horn orifices 54**.

When the control ring 27 is rotated through the intermediate position as shown in FIG. 6, the orifice 41 still remains open, the spiral end section 77 of the control ring slot 73 begins to block the baffle passage **49*c* and the spiral end section 80 of the control ring slot 74 begins to block the baffle passage 49*a*. As the passages 49*a* and 49*c* become blocked, fan air flow is reduced. Further rotation of the control ring 27 first causes the passages 49*a* and 49*c* to become further blocked and then causes the passages 49*b* and 49*d* to become progressively blocked. As the passages 49*a*, 49*b*, 49*c* and 49*d* become progressively blocked by the control ring 27, the spiral control ring surface 80 simultaneously progressively blocks the orifice 41. By the time the control ring 27 is rotated to the second position as shown in FIG. 7, the baffle holes 49*a*, 49*b*, 49*c* and 49*d* and the orifice 41 are completely blocked. Consequently, fan air is totally interrupted and air flow through the orifice 41 is totally interrupted. Atomization air is now totally supplied through the orifice 40. If the maximum atomization and fan air pressures are to be restricted to no more than 10 psig, the orifice 40 is sized to provide 10 psig of atomization air when the control ring 27 is in the second position and the orifice 41 is sized to provide with the orifice 40 a total of 10 psig atomization air and fan air when the control ring 27** is in the first position. Accordingly, the atomization air pressure may be maintained at substantially the maximum permitted pressure without being substantially affected by the fan air control ring setting.

Figure 8:
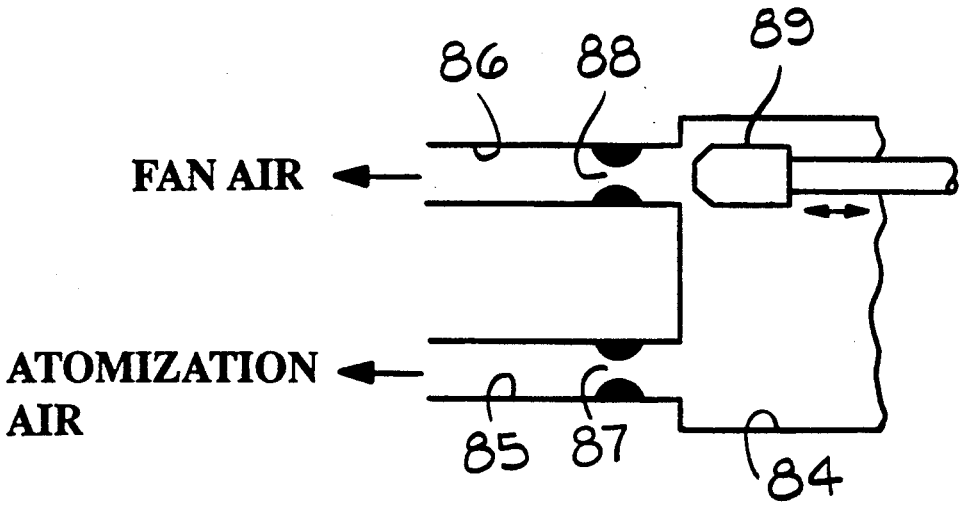
FIG. 8 is diagrammatic view showing the air flow through a portion of the body and nozzle assembly for a spray gun according to a modified embodiment of the invention.

FIG. 8 is a diagrammatic illustration of the operation of a modified embodiment of an HVLP spray gun suitable for operation from a high pressure air source. High pressure air is delivered to a chamber 84 in a manner similar to the spray gun 10 of FIG. 1. The chamber 84 has two outlet passages 85 and 86. The passage 85 is connected to supply only atomization air and the passage 86 is connected to supply only fan air for shaping the pattern of the atomized paint. An orifice 87 is located in the passage 85 for dropping the pressure of the air flowing from the chamber 84. The orifice 87 is calibrated to limit the atomization air pressure to a predetermined maximum low pressure, such as to less then 10 psig. An orifice 88 is located in the passage 86 is calibrated to limit the fan air pressure in the passage 86 to a predetermined maximum.

A valve 89 is located in the high pressure chamber 84. The valve 89 is axially adjustable to open or close the fan air passage 86. When the valve 89 is positioned with the fan air passage 86 open, fan air flows uninhibited and a fan shaped spray pattern will be produced. Closing the valve 89 inhibits the flow of fan air and a round spray pattern will be produced. Because the valve 89 controls only the flow of fan air and because the low pressure sides of the orifices 87 and 88 are not connected together, there is only a slight change in the high pressure in the chamber 84 when the valve 89 is adjusted. This slight pressure change will produce only a slight pressure change in the atomization air downstream of the orifice 87. For example, if the chamber 84 has an air pressure of 80 psig when fan air is flowing, it may have a slightly higher pressure of about 82 psig when fan air flow is stopped. The 2 psig increase may in turn result in between 0.2 and 0.3 psig increase in the atomization air pressure. If the high pressure air were dropped to a low pressure through a single orifice which supplies both atomization air and fan air and the atomization air pressure is set to about 10 psig with fan air off, the pressure may drop to only 5 or 6 psig when fan air is turned on. Accordingly, there is a significant improvement in using two parallel orifices in place of a single orifice to drop the high pressure air to low pressure air for atomization air and fan air.

Figure 9:
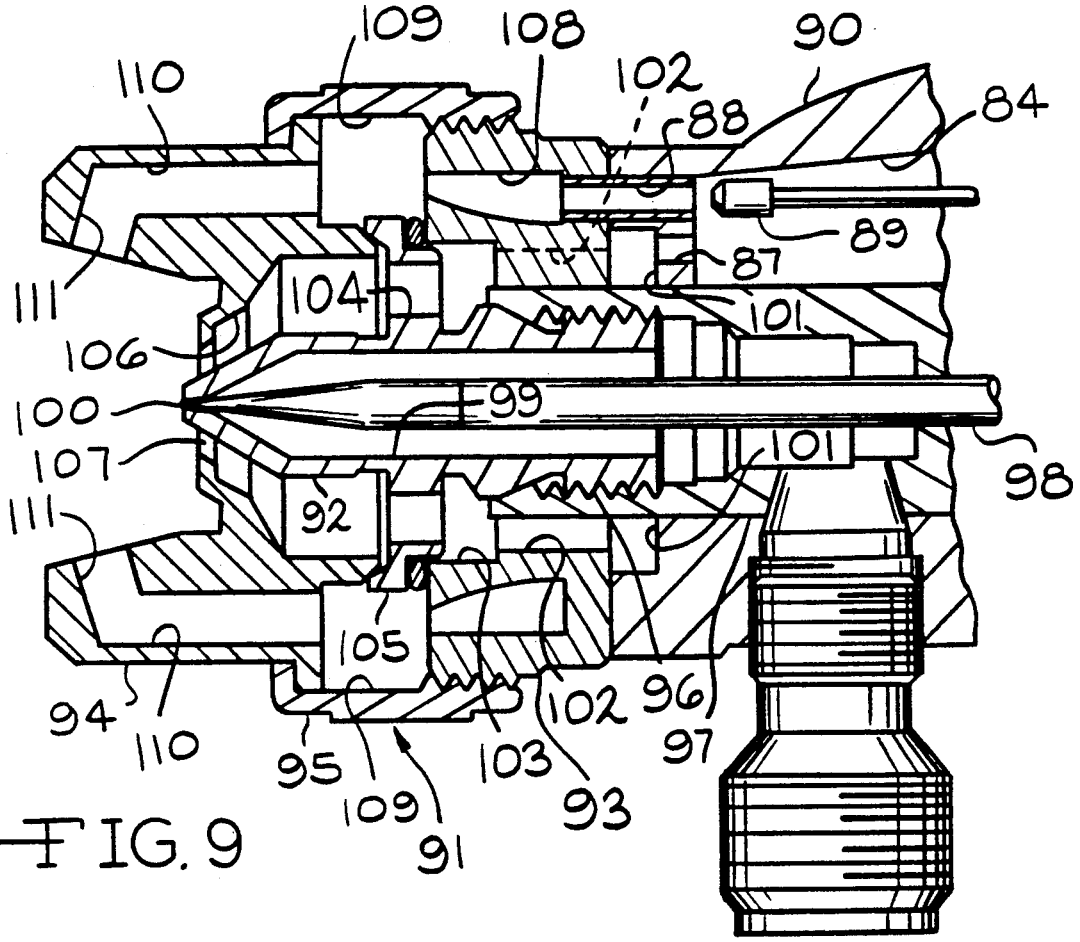
FIG. 9 is a fragmentary vertical cross sectional view through the front section of a spray gun body and a nozzle assembly for a spray gun operating according to the modified embodiment illustrated in FIG. 8.

FIG. 9 is a fragmentary cross sectional view through a front body section 90 and a nozzle assembly 91 of a modified spray gun for operating in accordance with the diagram of FIG. 8. The nozzle assembly 91 includes a spray tip 92, a baffle 93, an air cap 94 and an air cap retainer ring 95. The spray tip 92 has an end 96 which is threaded into an insert 97 in the front body section 90 to retain the nozzle assembly 91 on the gun body section 90. A fluid valve needle 98 extends coaxially through a paint chamber 99 in the spray tip 92 and normally closes a paint discharge orifice 100. Atomization air flows from the high pressure chamber 84 in the gun body through the calibrated pressure reducing orifice 87 to a chamber 101, through passages 102 formed between the baffle 93 and the insert 92 to a chamber 103, and through a plurality of passages 104 in a flange 105 on the spray tip 92 to a chamber 106. An annular orifice 107 surrounding the paint discharge orifice 100 directs atomization air from the chamber 106 against the stream of discharged paint to atomize the paint.

The fan air orifice 88 is illustrated as a tube pressed into or otherwise secured to the baffle 93. The tube is selected to have a calibrated internal diameter for providing a desired air pressure drop. The orifice 88 is connected through a chamber 108 in the baffle 93 to a chamber 109 between the baffle 93 and the air cap 94. Fan air flows from the chamber 109 through air cap passages 110 to fan air discharge orifices 111 for modifying the spray pattern. Fan air flow is adjusted by moving the valve 89 in the high pressure chamber 84 towards or away from the orifice 88.

It will be appreciated that various modifications and changes may be made in the above described embodiments of HVLP spray guns suitable for operation from high pressure air sources. For example, the design of the spray tip, the baffles and the control ring may be modified by those skilled in the art without departing from the invention. It also will be appreciated that a suitable fitting may be added to the spray gun for diverting a small portion of the low pressure atomization air to pressurize a paint cup (not shown). Various other modifications and changes may be made without departing from the spirit and the scope of the following claims.

We claim:

1. An improved paint spray gun including a gun body having a chamber to which high pressure air is supplied, said gun having a nozzle assembly including an orifice from which paint is discharged and atomized by a flow of atomization air and at least two fan orifices from which fan air may be discharged for shaping the pattern of the atomized paint, said spray gun being characterized by a first passage delivering low pressure air to atomize paint, a second passage delivering low pressure air to said fan orifices to control the pattern of the atomized paint, a first calibrated orifice connecting said high pressure air chamber to said first passage, a second calibrated orifice connecting said high pressure air chamber to said second passage, said first orifice having a size to drop said high pressure air to a predetermined maximum low pressure in said first passage, said second orifice having a size to drop said high pressure air to a predetermined maximum low pressure in said second passage, and valve means for controlling air flow through said second orifice to said second passage to control the flow of fan air.

2. An improved paint spray gun, as set forth in claim 1, wherein said valve means is located between said chamber and said second orifice.

3. An improved paint spray gun, as set forth in claim 2, wherein said high pressure air is at least 60 psig, wherein said first orifice drops said high pressure air to no more than 10 psig, and wherein said second orifice drops said high pressure air to no more than 10 psig when said valve means is open to provide a maximum fan air flow.

4. An improved paint spray gun, as set forth in claim 1, and including a low pressure air chamber connected to receive air from said first and second orifices, and wherein said first and second passages are connected to said low pressure air chamber.

5. An improved paint spray gun, as set forth in claim 4, and wherein said valve means comprises a first valve located to control air flow from said second orifice to said low pressure chamber and a second valve located to control air flow in said second passage, and means for simultaneously adjusting said first and second valves.

6. An improved paint spray gun, as set forth in claim 5, wherein said adjusting means comprises a fan air control ring mounted on said gun body to rotate between first and second positions, and wherein said first and second valves are both open when said control ring is in said first position and are both closed when said control ring is in said second position.

7. An improved paint spray gun, as set forth in claim 6, wherein said high pressure air is at least 60 psig, wherein said first orifice drops said high pressure air to no more than 10 psig, and wherein said second orifice drops said high pressure air to no more than 10 psig when said valve means is open to provide a maximum fan air flow.

8. An improved paint spray gun including a gun body having a chamber to which high pressure air is supplied, said gun having a nozzle assembly including an orifice from which paint is discharged and atomized by a flow of atomization air and at least two fan orifices from which fan air may be discharged for shaping the pattern of the atomized paint, said spray gun being characterized by parallel first and second calibrated orifices connecting said high pressure air chamber to a low pressure air chamber, said orifices having a size to drop said high pressure air to a predetermined maximum low pressure in said low pressure chamber, a first passage delivering air from said low pressure chamber to atomize paint, a second passage delivering low pressure air from said low pressure chamber to said fan orifices to control the pattern of the atomized paint, and valve means for simultaneously controlling air flow through said second orifice and said second passage to control the flow of fan air while maintaining the pressure of said atomization air below said predetermined maximum low pressure.

9. An improved paint spray gun, as set forth in claim 8, wherein said first and second orifices are in said gun body, wherein said valve means includes a fan air control ring secured on said gun body to rotate between first and second positions, said control ring having a passage located to connect said low pressure chamber to said second passage when said control ring is in said first position and to block air flow from said low pressure chamber to said second passage when said control ring is rotated to said second position.

10. An improved paint spray gun, as set forth in claim 9, wherein said control ring has a surface portion abutting said gun body and said control ring passage, said surface portion blocking air flow from said second orifice to said low pressure chamber when said control ring is in said second position.

11. An improved paint spray gun, as set forth in claim 10, wherein said high pressure air is at least 60 psig, wherein said first orifice drops said high pressure air to no more than 10 psig in said first passage when said valve means is closed to block fan air flow, and wherein said first and second orifices drop said high pressure air to no more than 10 psig when said valve means is open to provide a maximum fan air flow.

* * * * *